US005377168A

United States Patent [19]

Kotanagi

[11] Patent Number: 5,377,168

[45] Date of Patent: Dec. 27, 1994

[54] MULTIFUNCTIONAL ELECTRONIC TIMEPIECE

[75] Inventor: Susumu Kotanagi, Tokyo, Japan

[73] Assignee: Seiko Instruments Inc., Japan

[21] Appl. No.: 606,552

[22] Filed: Oct. 31, 1990

[30] Foreign Application Priority Data

Nov. 10, 1989 [JP] Japan ..... 1-131242[U]
Jul. 25, 1990 [JP] Japan ..... 2-78950[U]

[51] Int. Cl.[5] ..... G04B 19/30; G04B 19/00; G04B 27/02

[52] U.S. Cl. ..... 368/69; 368/76; 368/185; 368/190

[58] Field of Search ..... 368/101, 69–74, 368/185–187, 190, 223

[56] References Cited

U.S. PATENT DOCUMENTS

| | | | |
|---|---|---|---|
| 3,733,803 | 5/1973 | Hiraga et al. | 58/23 R |
| 3,733,810 | 5/1973 | Girard | 368/185 |
| 3,733,810 | 5/1973 | Girard | 58/4 A |
| 4,019,037 | 4/1977 | Monna | 368/10 |
| 4,444,511 | 4/1984 | Ogihara et al. | 368/68 |
| 4,451,159 | 5/1984 | Tanaka | 368/69 |
| 4,677,344 | 7/1987 | Inoue | 368/69 |
| 4,726,687 | 2/1988 | Gander | 368/10 |

FOREIGN PATENT DOCUMENTS

| | | |
|---|---|---|
| 2501389 | 9/1982 | France . |
| 2097562 | 11/1982 | United Kingdom . |

OTHER PUBLICATIONS

Patent Abstracts of Japan, vol. 6, No. 38 (P-105) (916) Mar. 9, 1982.

*Primary Examiner*—Vit W. Miska
*Attorney, Agent, or Firm*—Bruce L. Adams; Van C. Wilks

[57] ABSTRACT

A timepiece having a mode displaying function includes an external operating member that is rotatable by a user. A sliding pinion rotatable by the external operating member rotates a transmitting gear. A correction transmitting wheel is rotatable by the transmitting gear. A motion control gear is fixed to the correction transmitting wheel. A motion control spring member having a motion control part contacts with a respective motion control face of the teeth of the motion control gear to regulate the rotation of the correction transmitting wheel during the rotation of the motion control gear. A mode displaying plate is rotatable by the correction transmitting wheel and displays the modes of the timepiece. The mode displaying plate is fixed to a display gear which has a plurality of teeth. A spring member has an urging surface for contacting with a respective motion control face of the teeth of the display gear. Thus, during rotation of the display gear, the urging surface of the spring member regulates the rotation of the mode displaying plate so that the modes printed on the display plate are consistently viewable at the center of a display window on the dial of the inventive timepiece.

13 Claims, 6 Drawing Sheets

MULTIFUNCTIONAL ELECTRONIC TIMEPIECE

BACKGROUND OF THE INVENTION

The present device relates to a mode switching display structure of a multifunctional electronic timepiece.

In a conventional structure of a multifunctional electric timepiece, the rotation of a sliding pinion by an external operating member is transmitted to a first correction transmitting wheel to rotate a second correction transmitting wheel having a second and third correction transmitting gears at one end thereof and integrally supporting a motion control gear and a contact spring at the other end. A switch for selecting the display mode is formed of a circuit board having a pattern which is electrically connected to the contact spring, and rotation is transmitted to a mode display plate formed integrally with a fourth correction transmitting gear meshing with the third correction transmitting gear so that a mode display corresponding to the switch may be carried out. The third correction transmitting gear is integrally supported by the second correction transmitting wheel and is positioned by a motion control spring mating with the motion control gear. The fourth correction transmitting gear is formed integrally with the mode display plate meshing with the third correction transmitting gear.

Although the mode display plate formed integrally with the third and fourth correction transmitting gears is positioned by the motion control spring meshing with the motion control gear in such a mode switching display structure as stated above, the mode display plate formed integrally with the fourth correcting gear frequently undergoes a shift of position because of the backlashes of the third and fourth correction transmitting gears. As a result, the letters printed on the mode display plate are displayed in such a state that they are tilted with respect to the display window of a dial. Further, the size of the printed letters is restricted because it is necessary to make the display window of the dial larger than the mode printing letters in order that part of the letter is not obstructed by the edges of the window. In addition, it is disadvantageously difficult to design easy-to-read letters.

SUMMARY OF THE INVENTION

An object of the present device is to improve the visibility and designability of the mode display by controlling the shift of the mode display plate position.

In order to solve the foregoing problems in the present device, a spring member meshing with the fourth correction transmitting gear is provided, and a train-wheel structure in which the number of teeth to be regulated is equal to the number of modes or n (n=positive integer greater than 1) times the number of modes.

With this arrangement, there is provided a mode switching display structure corresponding to a mode switch and free from shifting the letters printed on the display plate from the display window of the dial.

DETAILED DESCRIPTION OF THE PREFERRED EMBODIMENTS

A detailed description will subsequently be given of preferred embodiments of the present invention.

Figure 1:
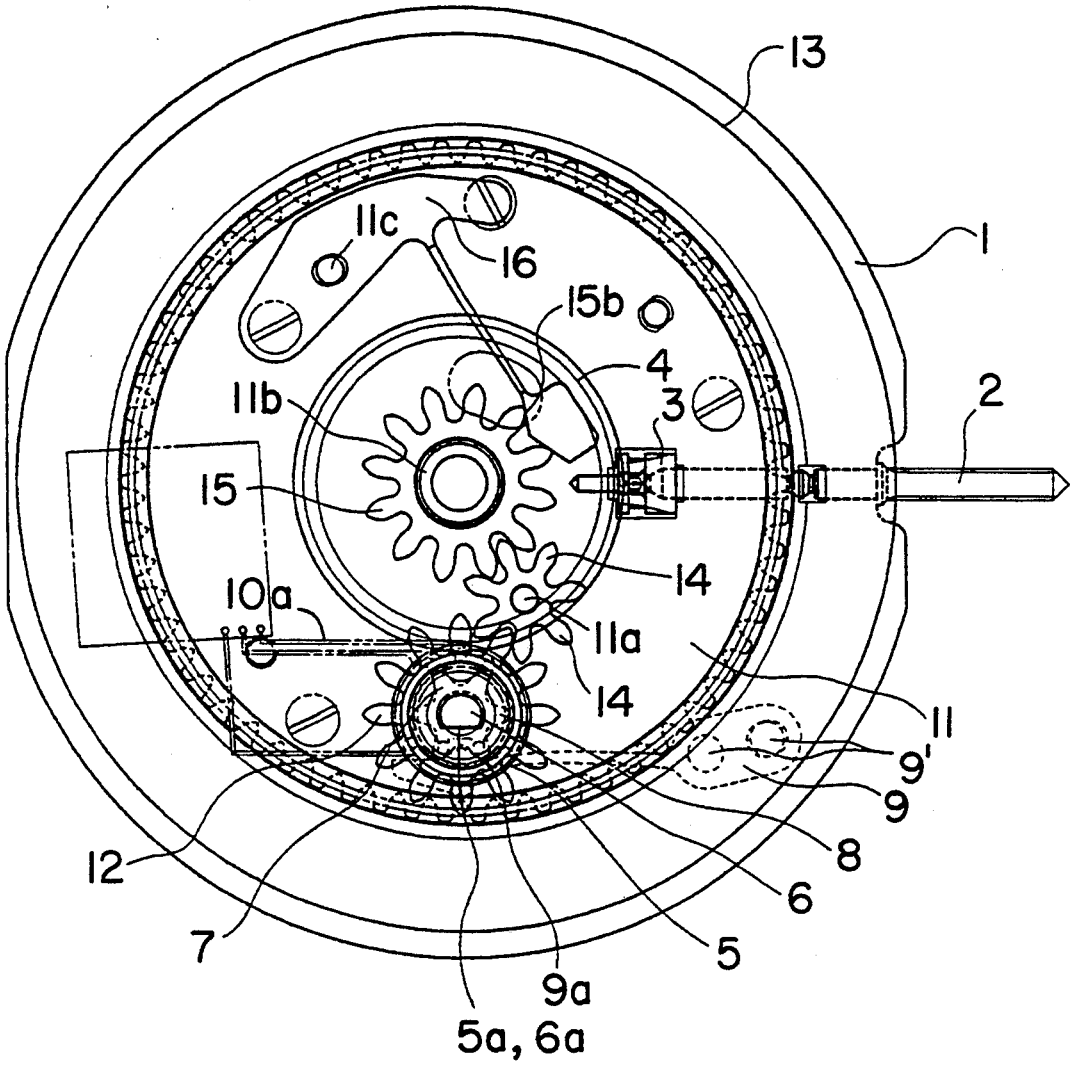
FIG. 1 is a plane view of a first embodiment of the present invention.
Figure 2:
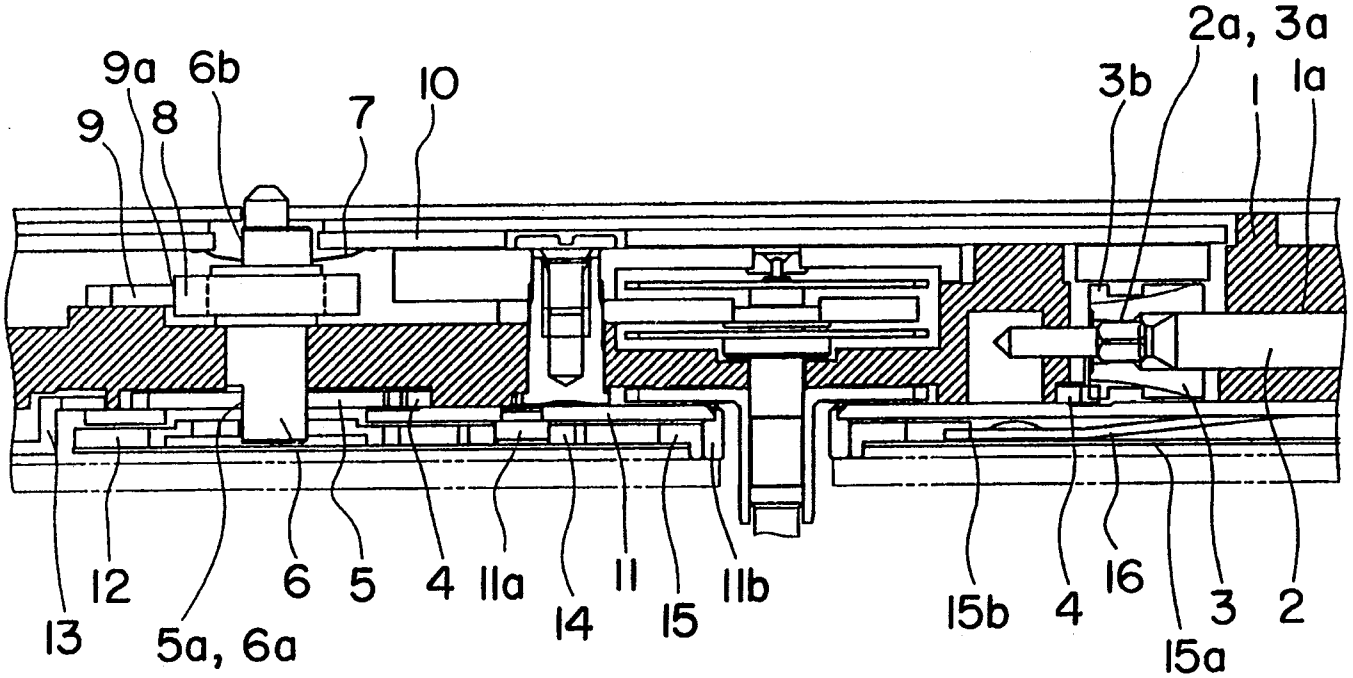
FIG. 2 is a sectional view thereof.
Figure 3:
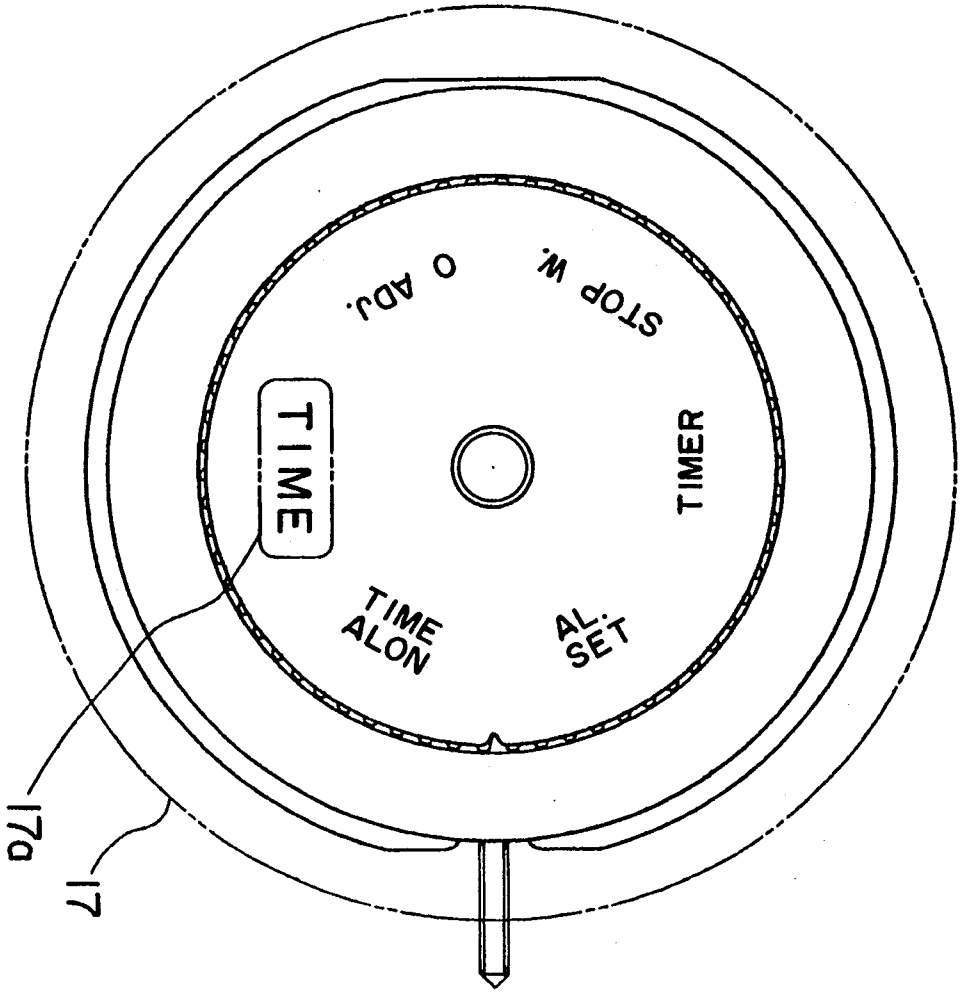
FIG. 3 is a plane view of a dial used in the first embodiment.

FIG. 1 is a plane view illustrating the structure of an embodiment 1 of the present invention. FIG. 2 is a sectional view thereof. FIG. 3 is a plane view illustrating the external appearance of a dial.

Next, the structure will be described. A guide hole 1*a* for an external operating member 2 is bored in a main plate 1 to pivotally support the external operating member 2. Further, a cornered part 2*a* formed on the external operating member and a cornered part 3*a* on the inner face of a sliding pinion 3 are fitted together, and positive teeth 3*b* provided on the sliding pinion 3 mesh with a first ring-like correction transmitting gear 4. The first correction transmitting gear 4 meshes with a second correction transmitting gear 5, and a cornered part 6*a* formed on a second correction transmitting wheel 6 is fitted into a hole 5*a* bored in the second correction transmitting gear 5.

In the second correction transmitting wheel 6, a contact spring 7 having an elastic arm is fitted in a cornered part 6*b* on a side opposite to the part incorporating the second correction transmitting gear 5, forming the integral structure of the second correction transmitting wheel 6. A motion control gear 8 is provided in the central part of the second correction transmitting wheel 6. The motion control gear 8 has a plurality of teeth each having a motion control face that is engageable with a motion control part 9*a* at the leading end of the elastic arm of a first motion control spring 9 with a pin 9' in the base plate 1 as a guide so as to position the second correction transmitting wheel 6. When the contact spring 7 mating with the second correction transmitting wheel 6 is brought into contact with a lead pattern 10*a* provided on a circuit board 10, a mode switching is effected. A presser plate 11 is placed by the guide of the pin planted in the base plate 1, and a third correction transmitting gear 12 is disposed thereover, the third correction transmitting gear 12 having a hole into which the cornered part 6*a* formed on the second correction transmitting wheel 6 is fitted. An intermediate wheel 14 is freely fitted to a guide pin 11*a* planted in the presser plate 11 to establish the mode display switching structure inside a date gear 13. A fourth correction transmitting gear 15 (or display gear) is idly fitted to a pin 11*b* planted in the presser plate 11 coaxially with the first correction transmitting gear 4 and caused to mesh with the intermediate wheel 14. The teeth of the third correction transmitting gear 12 and those of the fourth correction transmitting gear 15 are compatibly shaped, and the number of their teeth is twelve, twice the number of modes. In this case, the number of teeth of the correction transmitting gears 12 and 15 may be n (n=positive integer greater than 1) times the number of modes.

In order to position a mode display plate 15*a* formed integrally with the fourth correction transmitting gear 15, a second motion control spring 16 is placed with a pin 11*c* planted in the presser plate 11 as a guide and has an urging surface mated with the motion control face 15*b* of the fourth correction transmitting gear 15 to position the fourth correction transmitting gear 15.

The operation of the first embodiment will next be described. The sliding pinion 3 mating with the external operating member 2 rotates to cause the second correcting transmitting wheel 6 as well as the second correction transmitting gear 5 to rotate via the first correction transmitting gear 4 meshing with the positive teeth 3*b* of the sliding pinion 3. The apex of the first motion control gear 8 meshing with the motion control gear 8 formed on the second correction transmitting wheel is cleared to allow the contact with the following face, so that the second correction transmitting wheel 6 is regulated and positioned. At this time, the contact spring 7 simultaneously rotates implementing the mode switching. Rotation is transmitted from the third correction transmitting gear 12 meshing with the second correction transmitting wheel 6 via the intermediate wheel 14 to the fourth correction transmitting gear 15. The mode display plate 15*a* integrally formed with the fourth correction transmitting gear 15 also rotates to regulate the position of the fourth correction transmitting gear 15 by means of the second motion control spring 16. The mode selected by the contact spring 7 in the switch unit is displayed by means of the letters printed on the mode display plate 15*a* through the display window 17*a* provided in the dial 17.

Figure 4:
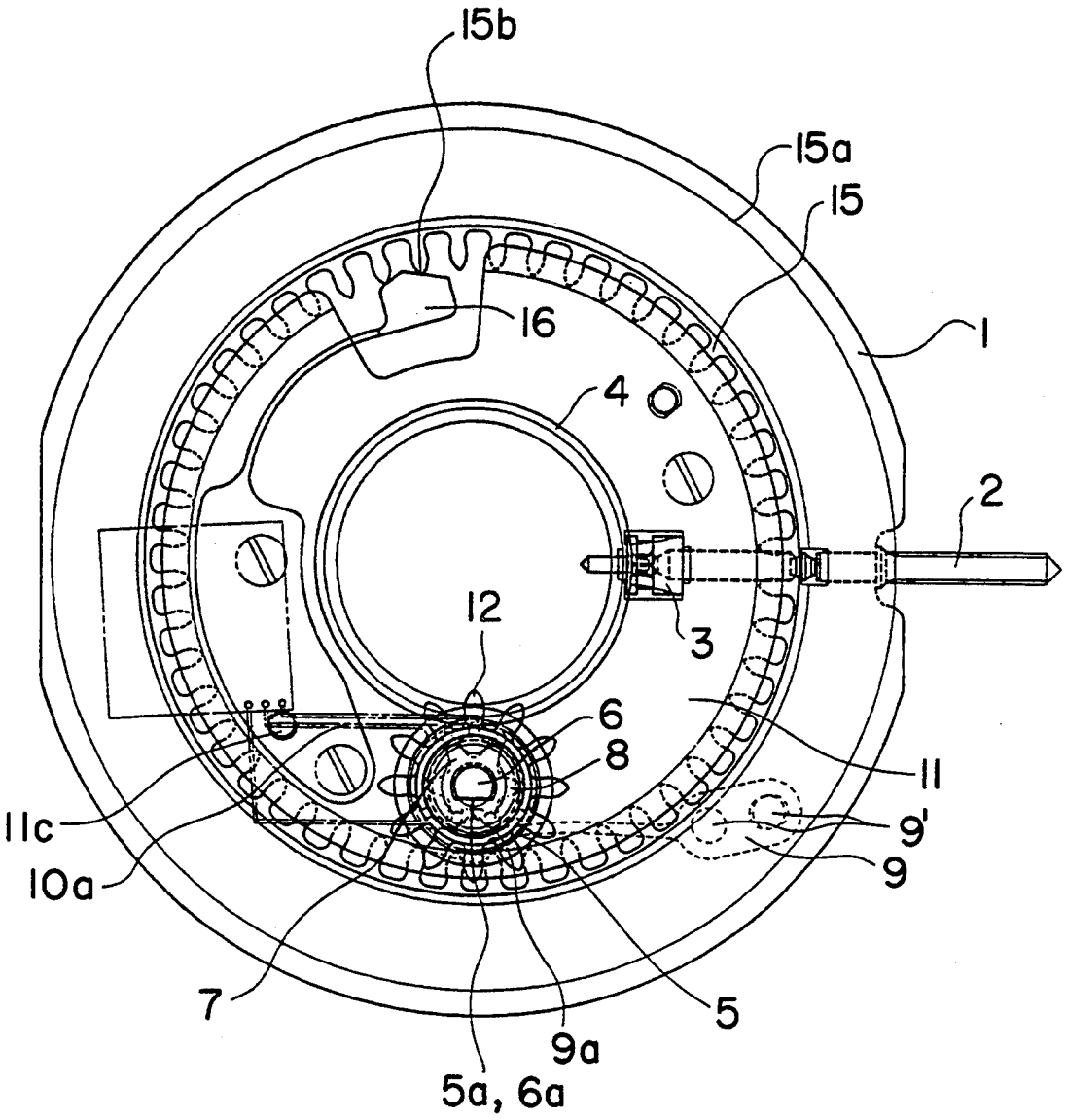
FIG. 4 is a plane view of a second embodiment of the present invention.
Figure 5:
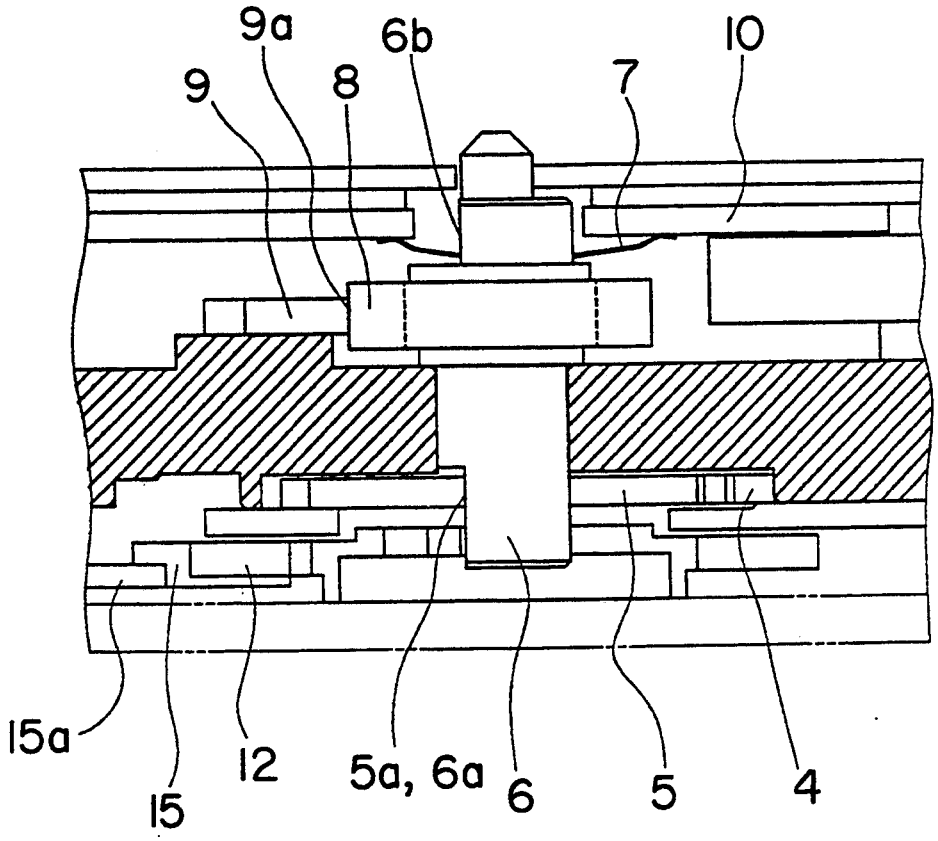
FIG. 5 is a sectional view thereof.

FIGS. 4 and 5 illustrate a second embodiment of the present device, and the difference between the first and second embodiment is ascribed to the arrangement that the central pin 11*b* is not used as the axis of the fourth correction transmitting gear 15 for carrying out the mode display but the tooth tip of the fourth correction transmitting gear 15 revolves round the outer periphery of the presser plate 11 as a guide. The fourth correction transmitting gear 15 rotates by the rotation of the third correction transmitting gear 12 and displays the mode selected by the contact spring 7 in the switch unit on the mode display plate 15*a* formed integrally with the fourth correction transmitting gear 15, using printed letters.

Figure 6:
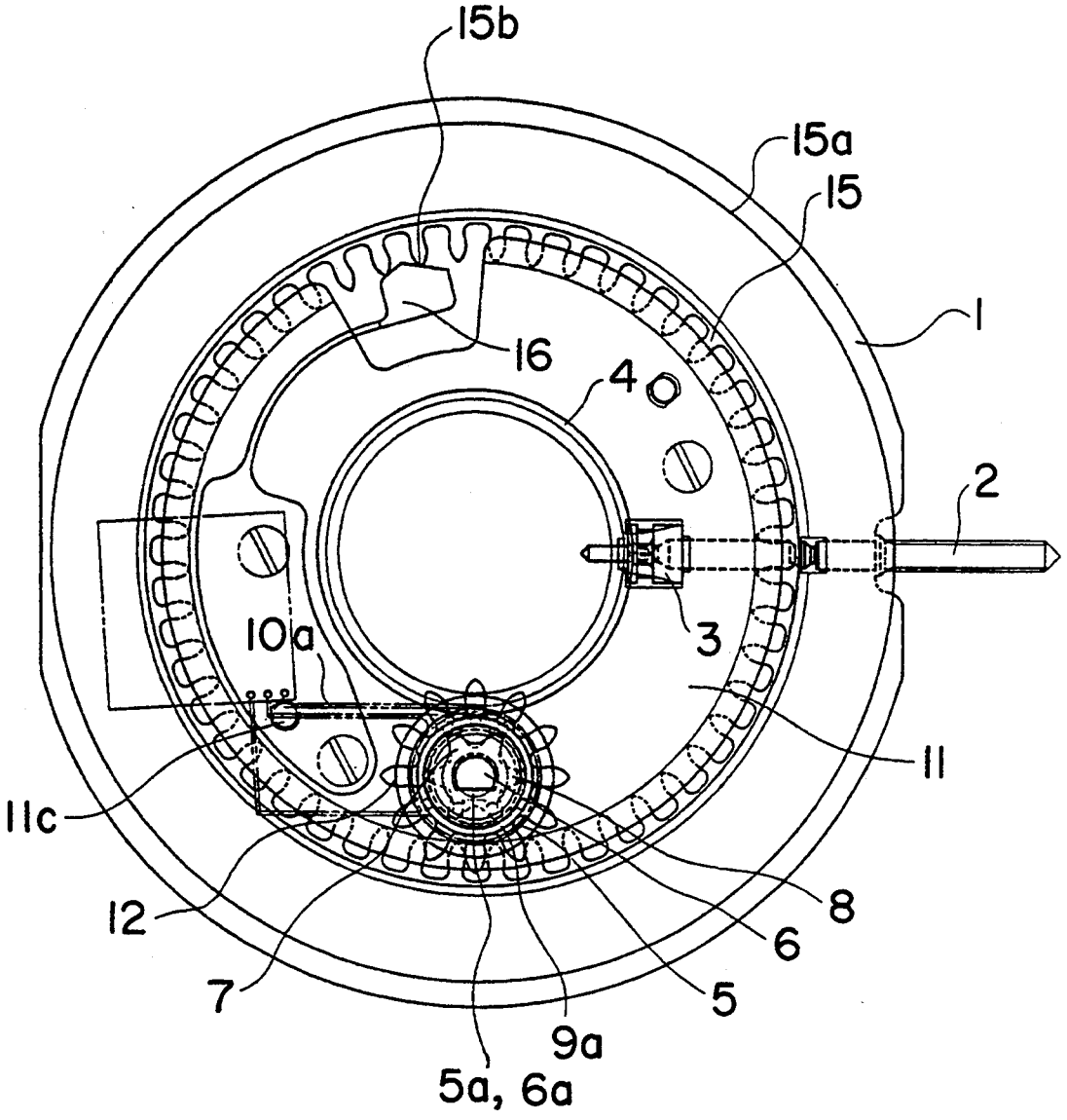
FIG. 6 is a plane view ok a third embodiment of the present invention.

Moreover, another structure where the first motion control spring 9 is omitted and only the second motion control spring 16, is used as shown in FIG. 6 can be adopted.

As set forth above, the implementation of the present device ensures the mode switching, the mode display without shift while securing a space for mode printing with a large-diameter mode display plate. As a result, the printing letter size can be made large, and display contents are made easy-to-read, which contributes to improvement is designability.

What is claimed is:

1. A timepiece having a mode displaying function, comprising: an external operating member rotatable by a user; a transmitting gear rotatable with the external operating member; a correction transmitting wheel rotatable by the transmitting gear; a mode displaying plate rotatable by the correction transmitting wheel for displaying at least one mode; a display gear fixed to the mode displaying plate and having a plurality of teeth each having a motion control face; and display motion controlling means for regulating the rotation of the mode displaying plate, the display motion controlling means comprising a spring member having an urging surface for contacting with a respective motion control face during rotation of the display gear to thereby regulate the rotation of the mode displaying plate; wherein the display gear has a number of teeth equal to an integer multiplied by a number of modes for display by the mode displaying plate; and a correction gear fitted to the correction transmitting wheel and having a same number of teeth as the display gear.

2. A timepiece having a mode displaying function according to claim 1; further comprising an intermediate wheel meshed between the display gear and the correction gear.

3. A timepiece having a mode displaying function, comprising: an external operating member rotatable by a user; a transmitting gear rotatable with the external operating member; a correction transmitting wheel rotatable by the transmitting gear; a mode displaying plate rotatable by the correction transmitting wheel for displaying at least one mode; a display gear fixed to the mode displaying plate and having a plurality of teeth each having a motion control face; and display motion controlling means for regulating the rotation of the mode displaying plate, the display motion controlling means comprising a spring member having an urging surface for contacting with a respective motion control face during rotation of the display gear to thereby regulate the rotation of the mode displaying plate; a motion control gear fixed to the correction transmitting wheel, the motion control gear having a plurality of teeth each having a motion control face; and a motion control spring member having a motion control part engageable with a respective motion control face of the motion control gear during rotation of the motion control gear to thereby regulate the rotation of the correction transmitting wheel.

4. A timepiece having a mode displaying function according to claim 3; further comprising a contact spring movable by the correction transmitting wheel; and a circuit board having a pattern electrically connectable to the contact spring depending on the movement of the contact spring to effect mode switching.

5. A timepiece having a mode displaying function according to claim 3; further comprising a sliding pinion rotatable by the external operating member for rotating the transmitting gear,

6. A timepiece having a mode displaying function, comprising: an external operating member rotatable by a user; a transmitting gear rotatable with the external operating member; a correction transmitting wheel rotatable by the transmitting gear; a mode displaying plate rotatable by the correction transmitting wheel for displaying at least one mode; display motion controlling means for regulating the rotation of the mode displaying plate; a display gear fixed to the mode displaying plate and having a number of teeth equal to an integer multiplied by a number of modes for display by the mode displaying plate; and a correction gear fitted to the correction transmitting wheel and having a same number of teeth as the display gear.

7. A timepiece having a mode displaying function according to claim 6; further comprising an intermediate wheel meshed between the display gear and the correction gear.

8. A timepiece having a mode displaying function, comprising: an external operating member rotatable by a user; a transmitting gear rotatable with the external operating member; a correction transmitting wheel rotatable by the transmitting gear; a mode displaying plate rotatable by the correction transmitting wheel for displaying at least one mode; displaying motion controlling means for regulating the rotation of the mode displaying plate; a motion control gear fixed to the correction transmitting wheel, the motion control gear having a plurality of teeth each having a motion control face; and a motion control spring member having a motion control part engageable with a respective motion control face of the motion control gear during rotation of the motion control gear to thereby regulate the rotation of the correction transmitting wheel.

9. A timepiece having a mode displaying function according to claim 8; further comprising a contact spring movable by the correction transmitting wheel; and a circuit board having a pattern electrically connectable to the contact spring depending on the movement of the contact spring to effect mode switching.

10. A timepiece having a mode displaying function according to claim 8; further comprising a sliding pinion rotatable by the external operating member for rotating the transmitting gear.

11. A timepiece having a mode displaying function, comprising: an external operating member rotatable by a user; a sliding pinion rotatable by the external operating member; a transmitting gear rotatable by the sliding pinion; a correction transmitting wheel rotatable by the transmitting gear; a motion control gear fixed to the correction transmitting wheel, the motion control gear having a plurality of teeth each having a motion control face; a motion control spring member having a motion control part engageable with a respective motion control face of the motion control gear during rotation of the motion control gear to thereby regulate the rotation of the correction transmitting wheel; a contact spring movable by the correction transmitting wheel; a circuit board having a pattern electrically connectable to the contact spring depending on the movement of the contact spring to effect mode switching; a mode displaying plate rotatable by the correction transmitting wheel for displaying at least one mode, the mode displaying plate being fixed to a display gear having a plurality of teeth each having a motion control face; and display motion controlling means for regulating the rotation of the display gear, the display motion controlling means comprising a spring member having an urging surface engageable with a respective motion control face during rotation of the display gear to thereby regulate the rotation of the mode displaying plate.

12. A timepiece having a mode displaying function according to claim 11; wherein the display gear has a number of teeth equal to an integer multiplied by a number of modes for display by the mode displaying plate; and further comprising a correction gear fitted to the correction transmitting wheel and having a same number of teeth as the display gear.

13. A timepiece having a mode displaying function according to claim 12; further comprising an intermediate wheel meshed between the display gear and the correction gear.

* * * * *